US005248843A

United States Patent [19]

Billings

[11] Patent Number: 5,248,843

[45] Date of Patent: Sep. 28, 1993

[54] ELECTRONIC MUSICAL INSTRUMENT WITH SOUND-CONTROL PANEL AND KEYBOARD

[75] Inventor: Zeb Billings, Hartland, Wis.

[73] Assignee: Sight & Sound Incorporated, New Berlin, Wis.

[21] Appl. No.: 652,789

[22] Filed: Feb. 8, 1991

[51] Int. Cl.[5] ..... G10H 7/00; G04B 13/00; A63H 5/00

[52] U.S. Cl. ..... 84/609; 84/626

[58] Field of Search ..... 84/600-604, 84/609-613, 620, 626, 644, 647, 649, 650, 653, 662, 666, 670, 678, 686, 701, 712, 718, 719

[56] References Cited

U.S. PATENT DOCUMENTS

| | | | |
|---|---|---|---|
| 4,646,610 | 3/1987 | Sakurai et al. | 84/636 |
| 4,662,262 | 5/1987 | Matsumoto | 84/650 |
| 4,742,748 | 5/1988 | Tateishi | 84/DIG. 12 X |
| 4,839,810 | 6/1989 | Abe | 84/DIG. 12 |
| 4,889,026 | 12/1989 | Abe | 84/611 |
| 4,974,486 | 12/1990 | Wallace | 84/609 |
| 5,074,182 | 12/1991 | Capps et al. | 84/609 |
| 5,155,286 | 10/1992 | Saito et al. | 84/611 |

FOREIGN PATENT DOCUMENTS

| | | | |
|---|---|---|---|
| 0315795 | 12/1989 | Japan | 84/609 |

OTHER PUBLICATIONS

National Semiconductor spec sheet "COP 413L/COP 313L Single Chip Microcontrollers".
Electronic Speech Systems, Inc. spec sheet "Sound Magician" ES 3116.
ES3000 Data Manual.
ES3116/ES3100 Data Manual.

*Primary Examiner*—William M. Shoop, Jr.
*Assistant Examiner*—Jeffrey W. Donels
*Attorney, Agent, or Firm*—Amster, Rothstein & Ebenstein

[57] ABSTRACT

An electronic musical instrument has a variety of keys including the following: a plurality of song keys for initiating the playing of a respective preprogrammed song and terminating the playing of any preprogrammed song in process, a plurality of sound effect keys for temporarily interrupting the playing of any preprogrammed song in process, inserting a respective special sound effect, and then resuming playing of any preprogrammed song which was in process, a plurality of note keys for playing a respective musical note and terminating the playing of any preprogrammed song in process, and a plurality of instrument keys for selecting the voice of any preprogrammed song being played and any musical note thereafter played. The instrument also includes solid state apparatus for producing sound, and a microcontroller for sensing actuation of each of the keys and selectively causing the sound producing means to produce particular sounds in accordance therewith.

22 Claims, 2 Drawing Sheets

ELECTRONIC MUSICAL INSTRUMENT WITH SOUND-CONTROL PANEL AND KEYBOARD

BACKGROUND OF THE INVENTION

The present invention relates to an electronic musical instrument, and more particularly to an electronic musical instrument which can play a plurality of preprogrammed songs, insert special sound effects, switch the preprogrammed songs being played between various voices, or operate in a play mode for playing particular musical notes A relatively wide variety of electronic musical instruments have recently become available. These instruments, primarily designed for children, are switchable between a play mode and a preprogrammed mode In the play mode, the user can sequentially actuate any of a plurality of note keys to cause the instrument to play a melody and thereby compose his own song. In the preprogrammed mode, the user can actuate any of a plurality of song keys to cause the instrument to play a preprogrammed song.

Even in those instruments which permit a selection of the preprogrammed song simply by actuating a particular song key, typically the newly selected preprogrammed song will not be played by the instrument until after the preprogrammed song in process is finished (i.e., completed). Indeed, where the user desires to switch from the preprogrammed mode to the play mode, typically he must wait until completion of the preprogrammed song in process before he can play musical notes by striking the note keys. (Indeed, in certain instruments the change from one preprogrammed song to another or the change between preprogrammed and play modes or even between voices is not easily accomplished by merely actuating a key, but requires changing of a cartridge or insertion of a separate element, a procedure which the youthful user may find just as uninteresting, frustrating, and bothersome as allowing a preprogrammed song to play to completion.) These restrictions may cause the youthful user to lose interest in the instrument, become frustrated and possibly even misperceive the instrument as defective.

During the playing of a preprogrammed song in the preprogrammed mode, the playing of particular songs is interrupted at predetermined times in order to permit the user to add special sound effects by actuating one of a plurality of sound effect keys, the actuation of a sound effect key causing the playing of the song to be resumed after playing of the special sound effect. While such instruments have the advantage of ensuring that the sound effects are added at the appropriate time from the point of either the composer of the song or the designer of the instrument, they fail to take into account the impatient nature of a child who wants to hear (i.e., insert) the sound effect when he wants to insert the sound effect, and not when the composer/manufacturer wants to permit the sound effect to be inserted. As the instrument is not immediately responsive to the desires of the user, the user may rapidly lose interest therein. Indeed, the failure of the instrument to respond to the pressing of a sound effect key each and every time that the user strikes that key may frustrate the user and even cause him to believe that the instrument is defective.

Some of the instruments permit the user to select one of a plurality of voices in which the preprogrammed song or a musical note will be played—that is, the particular type of instrument sound or tonal quality in which the preprogrammed song or the musical note will be played. While the instrument keys permit the voice to be selected prior to initiation of the playing of the preprogrammed song, typically the instrument keys are not effective to change the voice during playing of the preprogrammed song. For the reasons stated above with regard to the sound effect keys, this may result in loss of interest, frustration, and even perceived malfunction of the instrument.

Accordingly, it is an object of the present invention to provide an electronic musical instrument which, in the preprogrammed mode, responds to the actuation of any of its keys with an immediate audible response.

Another object is to provide such an instrument wherein, for example, in the preprogrammed mode the actuation of a sound effect key temporarily interrupts the playing of any preprogrammed song in process, inserts a respective special sound effect, and then resumes playing of the preprogrammed song.

A further object to provide such an instrument which at all times provides an immediate response to the actuation of a key, thereby maintaining the child's interest, avoiding his frustration, and proving the operability of the instrument.

It is another object of the present invention to provide such an instrument which utilizes only a single sound chip for producing sounds.

It is also an object to provide such an instrument which is economical to manufacture and of sturdy, rugged construction.

SUMMARY OF THE INVENTION

It has now been found that the above and related objects of the present invention are obtained in an electronic musical instrument comprising a plurality of keys, means for producing sound, and a microcontroller for sensing actuation of each of the keys and selectively causing the sound producing means to produce particular sounds in accordance therewith. The instrument includes the following keys:

(A) a plurality of song keys for initiating the playing of a respective preprogrammed song and terminating the playing of any preprogrammed song in process;

(B) a plurality of sound effect keys for temporarily interrupting the playing of any preprogrammed song in process, inserting a respective special sound effect, and then resuming playing of the preprogrammed song;

(C) a plurality of note keys for playing a respective musical note and terminating the playing of any preprogrammed song in process; and (D) a plurality of instrument keys for selecting the voice of any preprogrammed song being played and any musical note thereafter played.

In a preferred embodiment, the instrument includes an on switch for initiating playing of a preprogrammed song, which may be randomly selected. The microprocessor is switchable between a play mode and a preprogrammed mode, the microprocessor entering the play mode in response to actuation of a note key or the finishing of a preprogrammed song and entering the preprogrammed mode in response to actuation of a song key. The microprocessor also enters the preprogrammed mode in response to actuation of the on switch.

Upon actuation of one of the instrument keys, means, active when a preprogrammed song is not being played, play a brief preprogrammed song portion in the associated voice, and, when a preprogrammed song is being played, interrupt the playing of the preprogrammed song and thereafter resuming the playing of the preprogrammed song in the voice associated with the actuated instrument key. The terminating and resuming means interposes a preprogrammed riff intermediate the termination and the resumption, playing the preprogrammed riff in the associated voice.

A song key, upon actuation during playing of its respective preprogrammed song, re-initiates the playing of that respective preprogrammed song from its beginning.

The instrument optimally includes an ending key for terminating the playing of any preprogrammed song in process and thereafter playing a special ending segment. The special ending segment includes a special preprogrammed song portion, a special sound effect portion, and a special voice-over portion. The instrument may additionally include means, active upon the finish of any preprogrammed song, for playing such a special ending segment.

The sound effect keys may include keys for playing symbol crashes, steam whistles, horns and slide up-pops, and the instrument keys may include keys for playing bassoon, xylophone, hurdy-gurdy, wah-wah guitar and brass sounds.

The means for producing sound includes a sound chip (preferably only one sound chip) and a speaker operatively connected thereto.

BRIEF DESCRIPTION OF THE DRAWING

The above brief description, as well as further objects and features of the present invention, will be more fully understood by reference to the following detailed description of the presently preferred, albeit illustrative, embodiments of the present invention when taken in conjunction with the accompanying drawing wherein.

DETAILED DESCRIPTION OF THE PREFERRED EMBODIMENTS

Figure 1:
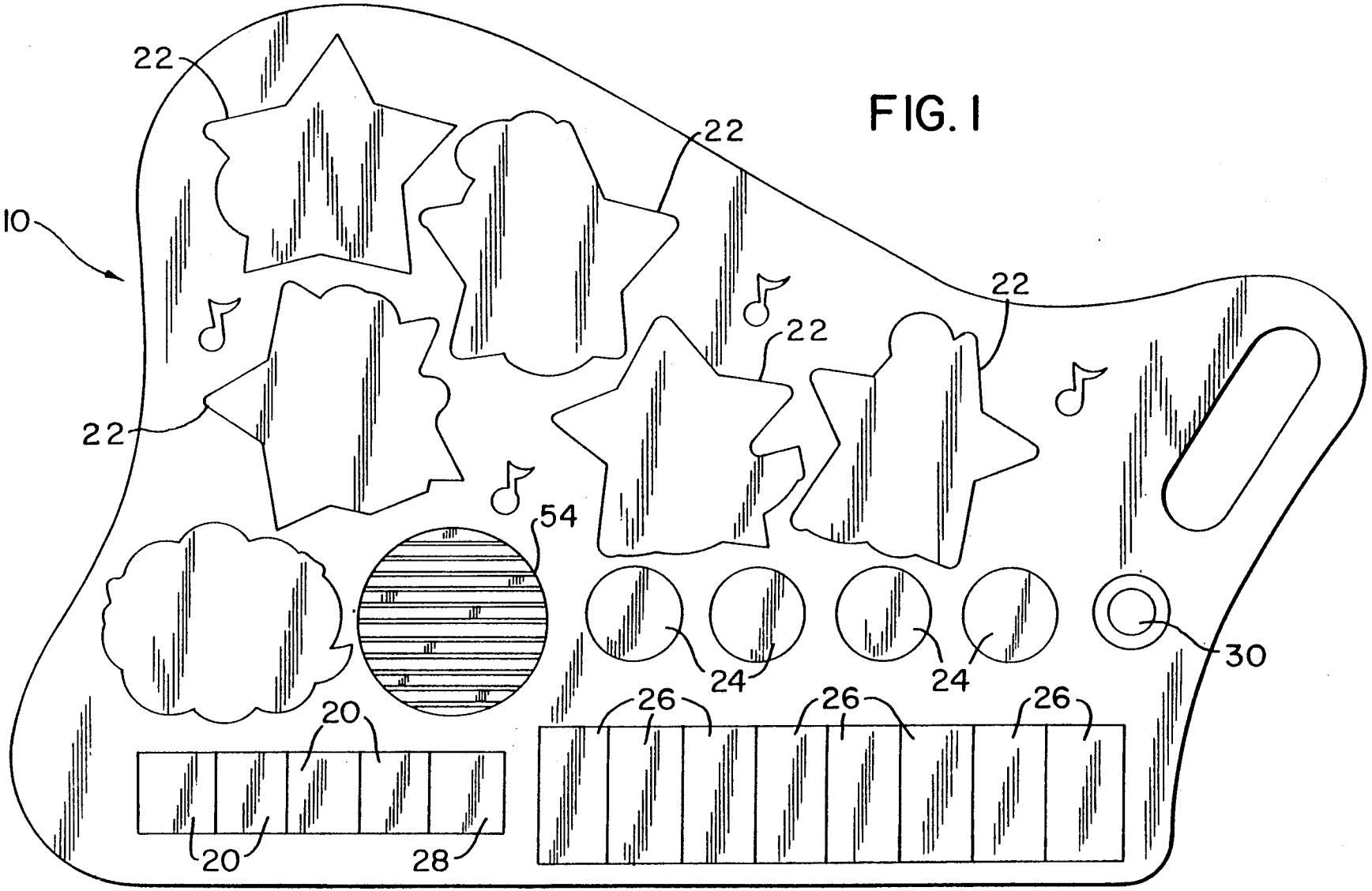
FIG. 1 is a top plan view of an electronic musical instrument according to the present invention.

Referring now to the drawing, and in particular to FIG. 1 thereof, therein illustrated is an electronic musical instrument according to the present invention, generally designated by the reference numeral 10. The top face 12 of the instrument 10 has a plurality of keys which may be actuated by depression and preferably bear icons or images indicative of the function of the key. It will be appreciated that the configuration and dimensions of the keys may be varied without departing from the principles of the present invention. Indeed, while the function selecting means is referred to herein as a "key," the term "key" is being used in its broadest sense and may include any function selecting means such as toggle switches, rotary dials, membrane switches, and the like.

On the face 12 are a plurality of square song keys 20 (four being illustrated) for initiating the playing of a respective preprogrammed song and terminating the playing of any preprogrammed song in process. The icons or images on the song keys 20 reflect the songs initiated thereby—for example, a star representing "Twinkle Twinkle Little Star," a bridge indicating "London Bridge is Falling Down," etc. Actuation of a song key 20 during playing of its respective preprogrammed song re-initiates the playing of that respective preprogrammed song from its beginning.

Also on the face 12 are a plurality of round sound effect keys 24 (four being illustrated) for temporarily interrupting the playing of any preprogrammed song in process, inserting a respective special sound effect, and then resuming play of any preprogrammed song which was in process. When the instrument is in the play mode actuation of a sound effect key 24 simply causes the associated sound effect to be played. While the selection of special sound effects for keys 24 will vary with the particular application intended for the instrument, preferred sound effects include cymbal crashes, steam whistles, horns, and a slide up-pop, each being indicated by an appropriate icon or image on the sound effect key 24.

Also on the face 12 are a plurality of rectangular note keys 26 (resembling piano keys) for playing respective musical notes in the play mode and terminating the playing of any preprogrammed song in process. While the selection of the number and sounds of the musical notes will vary with the particular application, preferably there are eight note keys 26 ranging over one octave from "C" to "C" as illustrated.

Further on the face 12 are a plurality of vaguely star shaped instrument keys 22 (five being illustrated) for selecting the voice of a preprogrammed song being played—that is, the instrumental sound in which the preprogrammed song (and any preprogrammed songs played thereafter) will be played until a different instrument key 22 is actuated. While the particular instruments selectable will be dependent upon the particular application intended for the instrument, a preferred selection includes a bassoon, xylophone, hurdy-gurdy, wah-wah guitar, and brass. Each of these instruments may be illustrated upon the associated instrument key 22, either alone or in combination with a cartoon or comic character playing the same. When an instrument key 22 is actuated during playing of a preprogrammed song, the playing of that preprogrammed song in the voice in which it was being played (whether that is the same voice or a different voice) is interrupted and thereafter the playing of the preprogrammed song is resumed in the voice associated with the actuated instrument key 22. Preferably intermediate the termination and the resumption, a preprogrammed riff or collection of notes is played as an immediate response to the actuation of the instrument key, the preprogrammed riff preferably being played in the voice associated with the actuated instrument key.

When a preprogrammed song is not in the process of being played but the instrument is in the preprogrammed mode, actuation of an instrument key 22 causes a riff or brief preprogrammed song portion to be played in the voice associated with the actuated instrument key 22. When the instrument is in the play mode, actuation of an instrument key 22 causes the musical notes played thereafter to be played in the voice associated with the actuated instrument key 22 until a different instrument key 22 is actuated.

The instrument 10 additionally includes an on switch 30 for turning the instrument on and initiating playing of a randomly selected preprogrammed song. While a separate off switch (not shown) may be provided, preferably the instrument automatically powers down after a predetermined time (for example, three minutes) without any key actuation to conserve batteries.

Optionally, the face 12 additionally includes a square ending key 28 for terminating the playing of any preprogrammed song in process and thereafter playing a special ending segment. While the special ending segment used in a given instrument will depend upon the intended application thereof, a preferred special ending segment may include a special riff or brief preprogrammed song portion, a special sound effects portion, and a special voice-over portion. The voice-over portion may be a fixed phrase or one randomly selected upon each actuation of the ending key 28 from a library of phrases (such as "Oh boy!" or "Great!") performed in a comic or cartoon-character style. The special sound effects portion may be randomly selected upon each actuation of the ending key 28 from those available by actuation of the sound effect keys 24 or may be a different sound effect.

In order to make the user aware that the natural completion or finishing of a preprogrammed song has been reached, the natural completion or finishing is preferably followed by a special ending segment which is preferably the same as that obtained by a depression of the ending key 28, but optionally different therefrom.

The instrument 10 is switchable between a play mode and a preprogrammed mode. The instrument enters the play mode in response to the actuation of a note key or the finishing of a preprogrammed song, and the instrument enters the preprogrammed mode in response to the actuation of a song key 22 or actuation of the on switch 30. Actuation of the on switch 30 causes a fixed or randomly selected one of the preprogrammed songs, with the special ending segment at the natural completion thereof, to be played. Playing of this song can, of course, be stopped while its play is in progress in a variety of different ways such as pressing a note key 26, actuating a different song key 20, or the like. In the play mode, the note keys 26 are active—that is, upon actuation of a note key 26, a respective musical note is played. In the preprogrammed mode, actuation of a note key 26 not only causes its respective musical note to be played, but also terminates the playing of any preprogrammed song in process—that is, switches the instrument to the play mode.

It will be appreciated by those in quality control that, as the pressing of any key interrupts the current functioning of the instrument and causes it to begin a new function (which may simply be changing the voice of the next musical note to be played), the instrument may rapidly be tested without waiting for each function in process to come to its natural conclusion or termination before initiating testing of the next function key.

Figure 2:
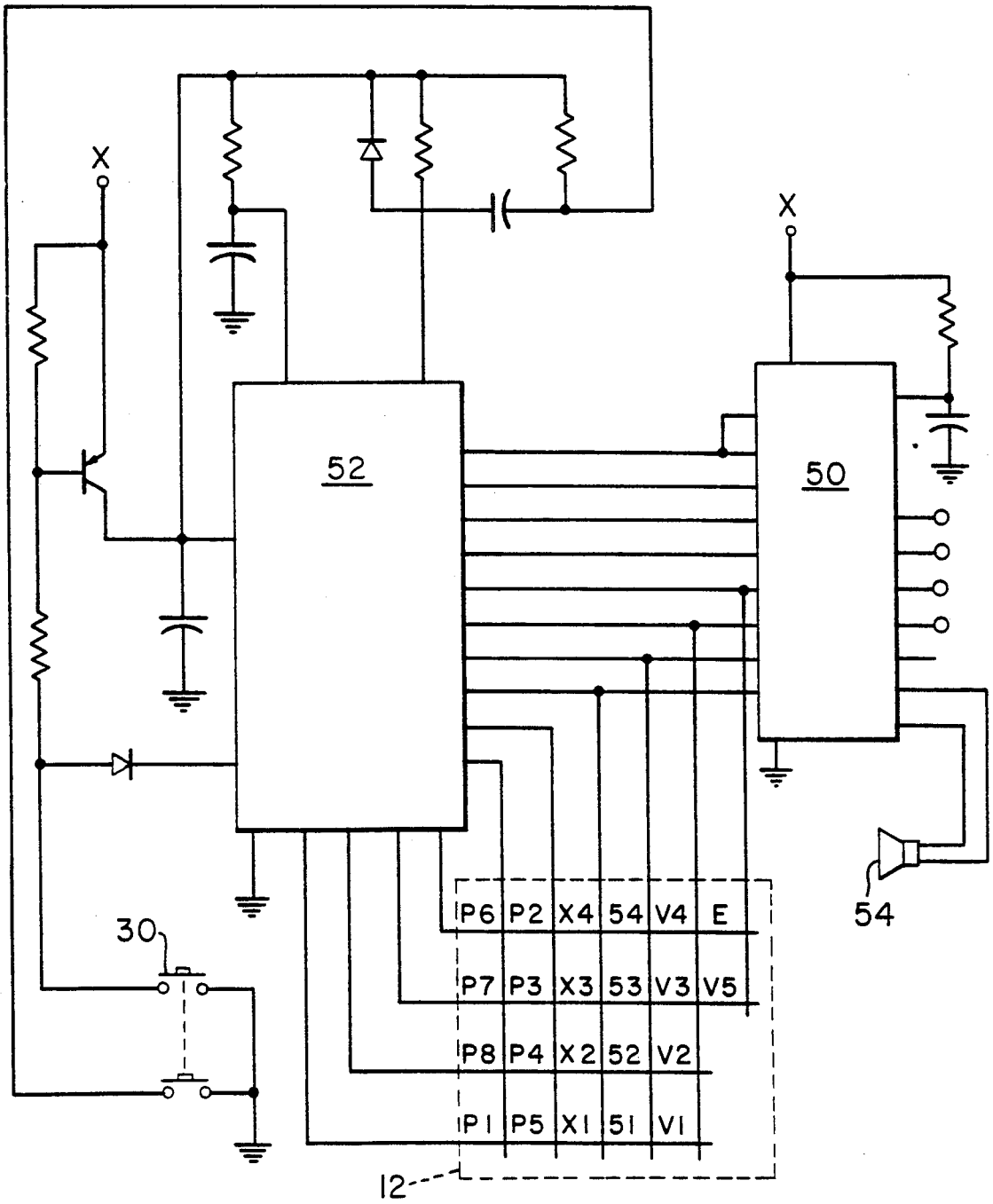
FIG. 2 is an electrical circuit diagram therefor.

Referring now to FIG. 2 in particular, the instrument 10 has two main electronic components: means 50 for producing sound, and a microcontroller 52 for sensing actuation of each of the keys (including the on switch 30) and selectively causing the sound producing means 50 to produce particular sounds in accordance therewith. More particularly, the microcontroller 52 is preferably a solid state integrated circuit, such as the custom programmed COPS 413L chip (available from National Semiconductor). The microcontroller 52 scans the keyboard for key actuations, stores preprogrammed songs in its memory, and controls the power-on and power-off circuitry (the latter preferably being a time-out control to save power). The microcontroller sends the appropriate control data to the sound producing means 50 via data bus control lines specifying voice, pitch and duration information. The sound producing means 50 is a solid state integrated circuit, such as the high quality custom programmed sound chip Sound Magician ES3116 (available from Electronic Speech Systems of Hayward, Calif.), having both a programmable logic area (PLA) and a programmable sound data area. The sound chip 50 drives a 32 ohm speaker 54 located within the instrument directly according to instructions received from the microcontroller 52. Both chips 50, 52 are programmable to enable the various keys and switches of the instrument to have the functions described herein. The detailed connection information for chips 50, 52, so that they provide the functions enclosed herein, may be obtained by referring to the specification sheets for the chips.

In FIG. 2, the designations P1 . . . P8 designate the note keys 26, the designations X1 . . . X4 represent the sound effect keys 24, the designations S1 . . . S4 represent the song keys 20, the designations V1 . . . V5 represent the instrument keys 22, and the designation E represents the ending key 28.

Power is controlled in conventional fashion with the use of an external transistor. Actuating the on switch 30 holds the transistor on long enough to power and reset the microcontroller 52, allowing it time to hold the transistor in the on state. When no key closures are sensed for a predetermined period (e.g., three minutes), the microprocessor 52 releases the transistor and power to the system is terminated.

In order to permit actuation of a sound effect key 24 to interrupt the playing of a preprogrammed song in process, cause the playing of the desired sound effect, and then permit resumption of the playing of the preprogrammed song without any loss of the notes of the preprogrammed song, the microprocessor may make use of a sound effect flag which is turned on before a sound effect is played and turned off once the sound effect is completed. Then, when the instrument 10 is in the preprogrammed song mode, before each succeeding note of the preprogrammed song is played, the microprocessor checks to see if the sound effect flag is "on" (indicating that a sound effect is in process). If so, the microprocessor waits until the sound effect flag is "off" (indicating that the sound effect has been completed) before causing the next note of the preprogrammed song to be played. The microprocessor may "wait" either by repeatedly testing of the sound effect flag status, either immediately or after a predetermined time interval. It will be appreciated that the sound effect flag may be any bi-stable memory unit (e.g., a bit or byte) which is controlled by either the microprocessor or sound chip to reflect whether or not a sound effect is currently in process. Where the microprocessor or sound chip knows the duration of the sound effect, the sound effect flag may be turned on for a predetermined period of time corresponding to the desired duration of the sound effect, which may differ one sound effect key to another. Otherwise, the microprocessor or sound chip may simply turn off the sound effect flag once the sound effect is completed.

While, as earlier indicated, a variety of different selecting devices may be used rather than the illustrated keys 20, 22, 24, 26, 28, the keys 20, 22, 24, 28 are preferably membrane keyboards configured and dimensioned to provide appropriate input to the microprocessor 52. For example, the instrument face 12 may consist of a multi-color label comprising an upper layer of mylar printed with an undercoating of conductive ink. A lower layer of mylar is printed with an overcoating of conductive ink. A paper layer is disposed intermediate the conductive inks of the upper and lower layers to act as a spacer, the insulative paper layer defining cutouts through which the conductive inks of the upper and lower layers may be placed in conductive contact when an appropriate area of the upper layer is depressed. The entire membrane keyboard is supported by a plastic support plate in the product housing. The minimum force required for key closure (preferably 1.0 lbs.) and the maximum force required to effect any key closure (preferably 2.5 lbs.) may be appropriately selected, depending upon the intended application of the instrument. As such membrane keyboards are well known, further details and illustrations thereof are not deemed necessary herein.

While the note keys 26 may be formed of membrane keyboards like the other keys 20, 22, 24, 28, preferably the note keys 26 are standard silicone rubber switches disposed on a printed circuitboard, with a living hinge design. Again, the maximum force required to effect key closure (preferably 3.0 lbs.) is selected in view of the intended application of the instrument. The on switch 30 is preferably a spring loaded cap that closes a silicone rubber switch, similar to the preferred note keys 26.

The instrument is preferably battery powered (as illustrated), although provision may be made for operatively connecting the same to a line circuit through an appropriate transformer. As is customary in order to permit a demonstration of the device at a retail store, non-replaceable button-cell batteries may be permanently installed in the instrument at the factory, sealed inside the instrument, and not accessible by the user for reasons of safety. When the unit requires replacement batteries, the consumer installs appropriate larger batteries, thereby mechanically disconnecting the button-cell batteries originally provided.

To operate the instrument 10, the user simply presses the on switch 30 to turn the instrument on and initiate playing of a randomly selected programmed song followed by a special ending segment. After completion of this song or during playing thereof, the user may change songs (by pressing a different song key 20), re-start the same song (by pressing the corresponding song key 20), change the voice in which the song is played (by pressing an instrument key 22 corresponding to a different voice), terminate playing of the song and initiate a special ending segment (by pressing the ending key 28), insert a special sound effect (by pressing a sound effect key 24), or abruptly terminate playing of the song and cause entry into the play mode and playing of a musical note (by pressing a note key 26). When the instrument is in the play mode, it may be switched to the preprogrammed mode by pressing a song key 20 or pressing the on switch 30.

To summarize, the electronic musical instrument of the present invention in the preprogrammed mode responds to the actuation of any of its keys with an immediate audible response—for example, the actuation of a sound effect key temporarily interrupts the playing of any preprogrammed song in process, inserts a special sound effect, and then resumes playing of the preprogrammed song. The instrument at all times provides an immediate response to the actuation of a key, thereby maintaining the child's interest, avoiding frustration and proving the operability of the instrument. The instrument is economical to manufacture and of sturdy, rugged construction, utilizing only a single sound chip for producing sounds.

Now that the preferred embodiments of the present invention have been shown and described in detail, various modifications and improvements thereon will become readily apparent to those skilled in the art. Accordingly, the present invention is to be construed broadly and limited only by the spirit and scope of the appended claims, and not by the foregoing specification.

I claim:

1. An electronic musical instrument comprising:

(A) a plurality of song keys for always initiating the playing of a respective preprogrammed song from the beginning and terminating the playing of any preprogrammed song in process, regardless of whether the song key for the preprogrammed song in process is still actuated;

(B) a plurality of sound effect keys for temporarily interrupting the playing of any preprogrammed song in process, inserting a respective special sound effect, and then always resuming playing of any preprogrammed song which was in process from the point at which it was interrupted, regardless of the length of the interruption;

(C) a plurality of note keys for playing a respective musical note and terminating the playing of any preprogrammed song in process;

(D) a plurality of instrument keys for selecting the voice of any preprogrammed song being played and any musical note thereafter played;

(E) means for producing sound; and (F) a microcontroller for sensing actuation of each of said keys and selectively causing said sound producing means to produce particular sounds in accordance therewith.

2. The instrument of claim 1 including an on switch for initiating playing of a preprogrammed song without a user preprogramming the song.

3. The instrument of claim 2 wherein said on switch initiates playing of a preprogrammed song randomly selected without input from the user of the instrument.

4. The instrument of claim 1 wherein said microprocessor is switchable between a play mode and a preprogrammed mode, said microprocessor automatically entering said play mode in response to actuation of a note key or the finishing of a preprogrammed song and entering said preprogrammed mode in response to actuation of a song key.

5. The instrument of claim 4 including an on switch separate and independent from said plurality of song keys, said microprocessor entering said preprogrammed mode in response to actuation of said on switch.

6. An electronic musical instrument comprising:

(A) a plurality of song keys for initiating the playing of a respective preprogrammed song and terminating the playing of any preprogrammed song in process;

(B) a plurality of sound effect keys for temporarily interrupting the playing of any preprogrammed song in process, inserting a respective special sound effect, and then resuming playing of any preprogrammed song which was in process;

(C) a plurality of note keys for playing a respective musical note and terminating the playing of any preprogrammed song in process;

(D) a plurality of instrument keys for selecting the voice of any preprogrammed song being played and any musical note thereafter played;
(E) means for producing sound;
(F) a microcontroller for sensing actuation of each of said keys and selectively causing said sound producing means to produce particular sounds in accordance therewith; and
(G) means, active upon actuation of one of said instrument keys when a preprogrammed song is not being played, for playing a brief preprogrammed song portion in the associated voice.

7. An electronic music instrument comprising:
(A) a plurality of song keys for initiating the playing of a respective preprogrammed song and terminating the playing of any preprogrammed song in process;
(B) a plurality of sound effect keys for temporarily interrupting the playing of any preprogrammed song in process, inserting a respective special sound effect, and then resuming playing of any preprogrammed song which was in process;
(C) a plurality of note keys for playing a respective musical note and terminating the playing of any preprogrammed song in process;
(D) a plurality of instrument keys for selecting the voice of any preprogrammed song being played and any musical note thereafter played;
(E) means for producing sound;
(F) a microcontroller for sensing actuation of each of said keys and selectively causing said sound producing means to produce particular sounds in accordance therewith; and
(G) means, active when one of said instruments keys is actuated during playing of a preprogrammed song, for interrupting the playing of the preprogrammed song and thereafter resuming the playing of the preprogrammed song in the voice associated with said actuated key.

8. The instrument of claim 7 wherein said terminating and resuming means interposes a preprogrammed riff intermediate the termination and the resumption.

9. The instrument of claim 8 wherein said terminating and resuming means plays the preprogrammed riff in the associated voice.

10. The instrument of claim 1 wherein said means for producing sound includes a sound chip and a speaker operatively connected thereto.

11. The instrument of claim 1 wherein said song key, upon actuation during playing of its respective preprogrammed song, always re-initiates the playing of that respective preprogrammed song from its beginning.

12. The instrument of claim 1 including an ending key for terminating the playing of any preprogrammed song in process and thereafter playing a special ending segment.

13. The instrument of claim 12 wherein said special ending segment includes a special preprogrammed song portion, a special sound effect portion, and a special voice-over portion.

14. The instrument of claim 1 additionally including means, always active upon the finish of any preprogrammed song, for automatically playing a special ending segment upon such finishing.

15. The instrument of claim 14 wherein said special ending segment includes a special preprogrammed song portion, a special sound effect portion, and a special voice-over portion.

16. The instrument of claim 1 wherein said sound effect keys include keys for playing cymbol crashes, steam whistles, horns and slide pops.

17. The instrument of claim 1 wherein said instrument keys include keys for playing bassoon, xylophone, hurdy-gurdy, wah-wah guitar and brass sounds.

18. The instrument of claim 1 including only one sound chip as said means for producing sound.

19. An electronic musical instrument comprising:
(A) a plurality of song keys for initiating the playing of a respective preprogrammed song and terminating the playing of any preprogrammed song in process, said song key upon actuation during playing of its respective preprogrammed song, re-initiating the playing of that respective preprogrammed song from its beginning;
(B) a plurality of sound effect keys for temporarily interrupting the playing of any preprogrammed song in process, inserting a respective special sound effect, and then resuming playing of any preprogrammed song which was in process;
(C) a plurality of note keys for playing a respective musical note and terminating the playing of any preprogrammed song in process;
(D) a plurality of instrument keys for selecting the voice of any preprogrammed song being played and any musical note played thereafter, said instrument key upon actuation interrupting the playing of any preprogrammed song in process and thereafter resuming playing of any preprogrammed song which was in process in the voice associated with said actuated instrument key;
(E) means for producing sound;
(F) a microcontroller for sensing actuation for each of said keys and selectively causing said sound producing means to produce particular sounds in accordance therewith, said microprocessor being switchable between a play mode and a preprogrammed mode, said microprocessor entering said play mode in response to actuation of a note key or the finishing of a preprogrammed song and entering said preprogrammed mode in response to actuation of a song key;
(G) an on switch, said microprocessor entering said preprogrammed mode in response to actuation of said on switch; and
(H) an ending key for terminating the playing of any preprogrammed song in process and thereafter playing a special ending segment.

20. An electronic musical instrument comprising means for playing a preprogrammed song and means for playing sound effects, said sound effect means upon actuation interrupting the playing of any preprogrammed song in process, causing the playing of sound effects, and then permitting resumption of the playing of the preprogrammed song from the point at which it was interrupted, regardless of the length of the interruption.

21. The instrument of claim 20 including only one sound chip as said means for producing sound.

22. An electronic musical instrument comprising:
(A) a plurality of song keys for initiating the playing of a respective preprogrammed song and terminating the playing of any preprogrammed song in process, said song key upon actuation during playing of its respective preprogrammed song re-initiating the playing of that respective preprogrammed song from its beginning;

(B) a plurality of sound effect keys for temporarily interrupting the playing of any preprogrammed song in process, inserting a respective special sound effect, and then resuming playing of any preprogrammed song which was in process;

(C) a plurality of note keys for playing a respective musical note and terminating the playing of any preprogrammed song in process;

(D) means for producing sound;

(E) a microcontroller for sensing actuation for each of said keys and selectively causing said sound producing means to produce particular sounds in accordance therewith, said microprocessor being switchable between a play mode and a preprogrammed mode, said microprocessor entering said play mode in response to actuation of a note key or the finishing of a preprogrammed song and entering said preprogrammed mode in response to actuation of a song key;

(F) an on switch, said microprocessor entering said preprogramed mode in response to actuation of said one switch; and (G) an ending key for terminating the playing of any preprogrammed song in process and thereafter playing a special ending segment.

* * * * *